United States Patent [19]

Covert

[11] Patent Number: 4,974,330

[45] Date of Patent: Dec. 4, 1990

[54] ANGLE DRAFTING SET

[76] Inventor: Paul B. Covert, 7233A Aloalo St., Honolulu, Hi. 96818

[21] Appl. No.: 528,368

[22] Filed: May 25, 1990

[51] Int. Cl.[5] ..... B43L 7/00

[52] U.S. Cl. ..... 33/474; 33/482

[58] Field of Search ..... 33/482, 429, 474, 476, 33/1 N, 534, 465

[56] References Cited

U.S. PATENT DOCUMENTS 827,989 8/1906 Noble ..... 33/474
2,532,329 12/1950 Premo ..... 33/474

FOREIGN PATENT DOCUMENTS 981857 1/1951 France ..... 33/429
303315 2/1955 Switzerland ..... 33/534

*Primary Examiner*—Harry N. Haroian
*Attorney, Agent, or Firm*—Michael I. Kroll

[57] ABSTRACT

An improved angle drafting set is provided and consists of a trapezium tool and an angle modifier tool. The trapezium tool is so constructed that a person can accurately draw angles in five degree increments between zero degrees and three hundred and sixty degrees. The angle modifier tool is so constructed that when used in conjunction with the trapezium tool the person can accurately draw angles in whole degree increments between zero degrees and three hundred and sixty degrees with the trapezium tool.

6 Claims, 2 Drawing Sheets

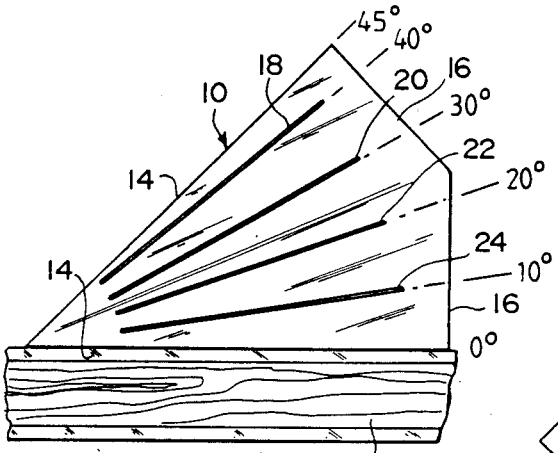
Fig. 4
Fig. 5
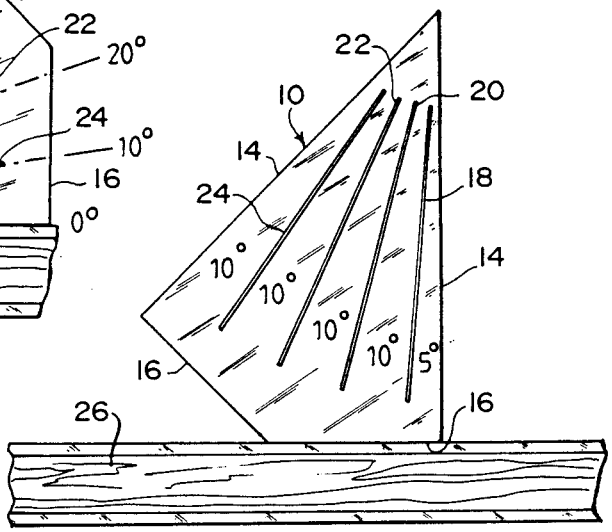
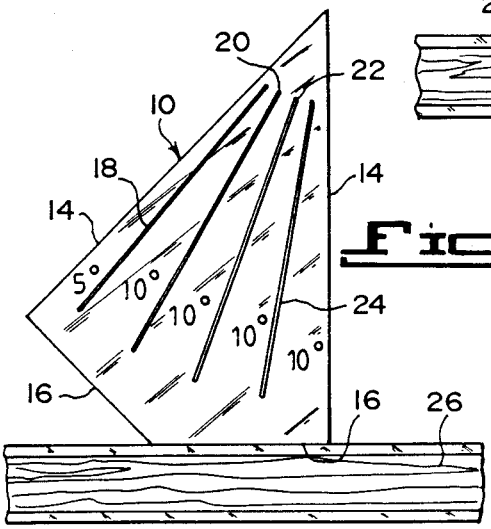
Fig6
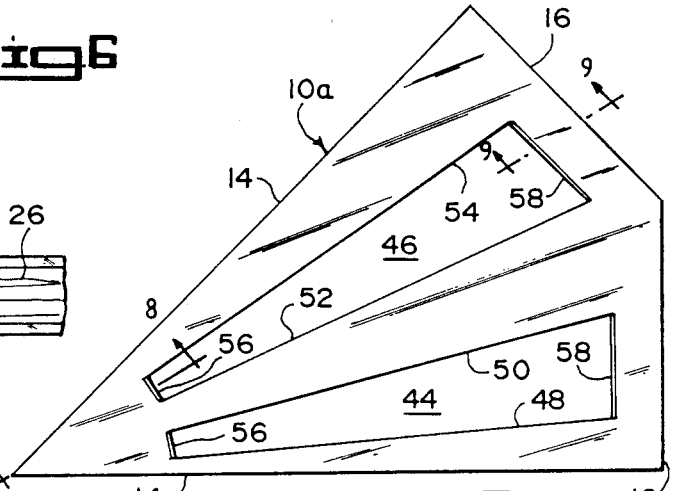
Fig. 7
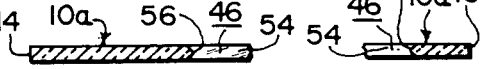
Fig. 8 Fig. 9
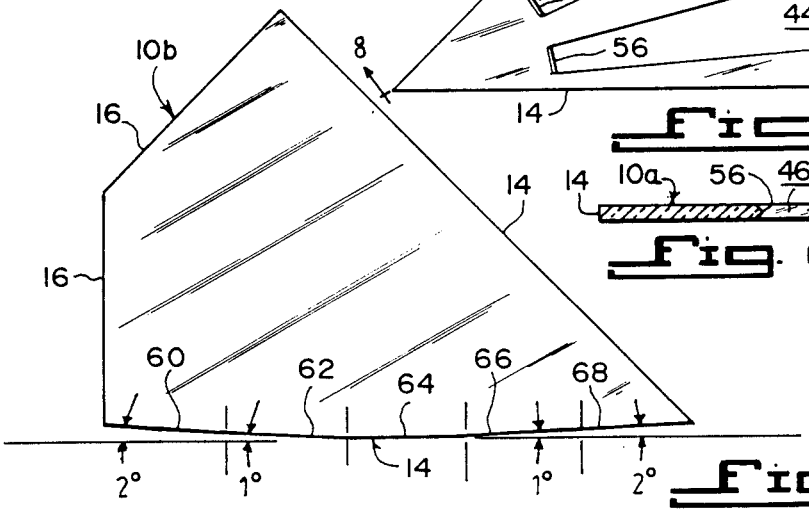
Fig10

ANGLE DRAFTING SET

BACKGROUND OF THE INVENTION

1. Field of the Invention

The instant invention relates generally to drafting triangles and more specifically it relates to an improved angle drafting set.

2. Description of the Prior Art

Numerous drafting triangles have been provided in prior art that are adapted to come in thirty-sixty degrees, forty five degrees and adjustable type, which can make only a limited amount of angles. While these units may be suitable for the particular purpose to which they address, they would not be as suitable for the purposes of the present invention as heretofore described.

SUMMARY OF THE INVENTION

A primary object of the present invention is to provide an improved angle drafting set that will overcome the shortcomings of the prior art devices.

Another object is to provide an improved angle drafting set which allows a person using the trapezium tool to accurately draw angles in five degree increments between zero degrees and three hundred and sixty degrees.

An additional object is to provide an improved angle drafting set which allows a person using the trapezium tool in conjunction with the angle modifier tool to accurately draw angles in whole degree increments between zero degrees and three hundred and sixty degrees.

A further object is to provide an improved angle drafting set that is simple and easy to use.

A still further object is to provide an improved angle drafting set that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a plan view of the trapezium tool of the instant invention.

FIG. 1*a* is an enlarged plan view as indicated by arrow 1*a* in FIG. 1 showing one double beveled cut off corner tip.

FIG. 1*b* is an enlarged perspective view as indicated by arrow 1*b* in FIG. 1 showing the other double beveled cut off corner tip.

FIG. 2 is a plan view of the angle modifier tool of the instant invention.

FIG. 2*a* is an enlarged view as indicated by arrow 2*a* in FIG. 2 showing one double bevel edge.

FIG. 2*b* is an enlarged view as indicated by arrow 2*b* in FIG. 2 showing the other double bevel edge.

FIG. 2*c* is an enlarged perspective view of the double bevel edge in FIG. 2*b*.

FIGS. 4, 5 and 6 show plan view of the trapezium tool being used in various positions against the T-square for drawing the angles.

FIG. 7 is a plan view of a first modification of the trapezium tool showing two large slots in place of the four slots.

FIG. 8 is a cross sectional view taken along line 8—8 in FIG. 7 showing one of the first inner bevel side edges.

FIG. 9 is a cross sectional view taken along line 9—9 in FIG. 7 showing one of the second inner beveled side edges.

FIG. 10 is a diagrammatic plan view of a second modification of the trapezium tool having each of its edges similar to the top edge of the angle modifier tool.

DETAILED DESCRIPTION OF THE PREFERRED EMBODIMENTS

Figure 1:
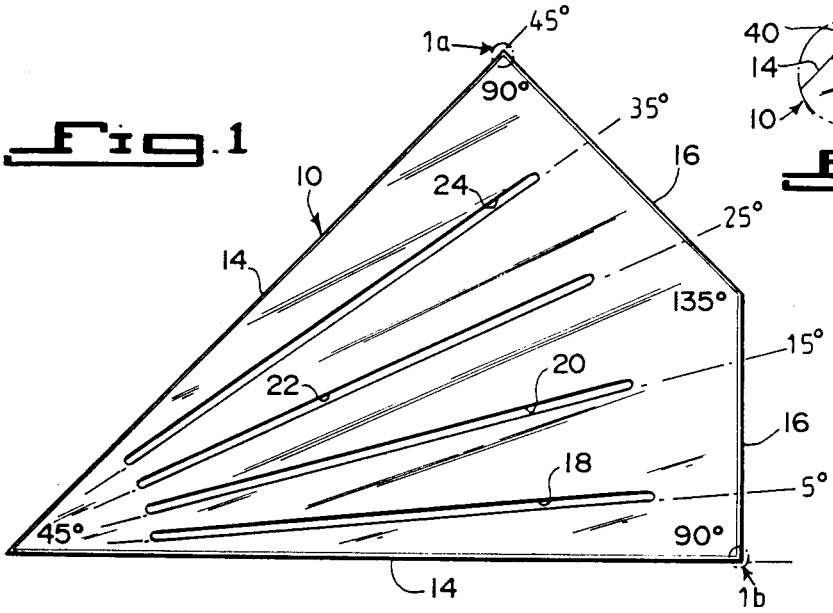
Figure 1A:
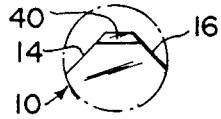
Figure 2:
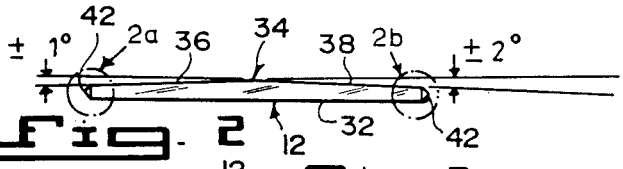
Figure 1B:
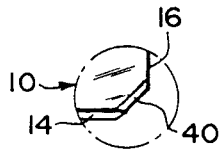
Figure 2A:
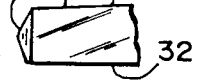
Figure 2B:
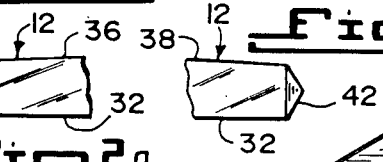
Figure 2C:
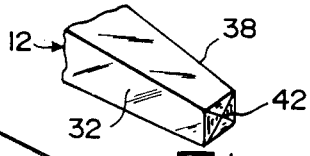
Figure 3:
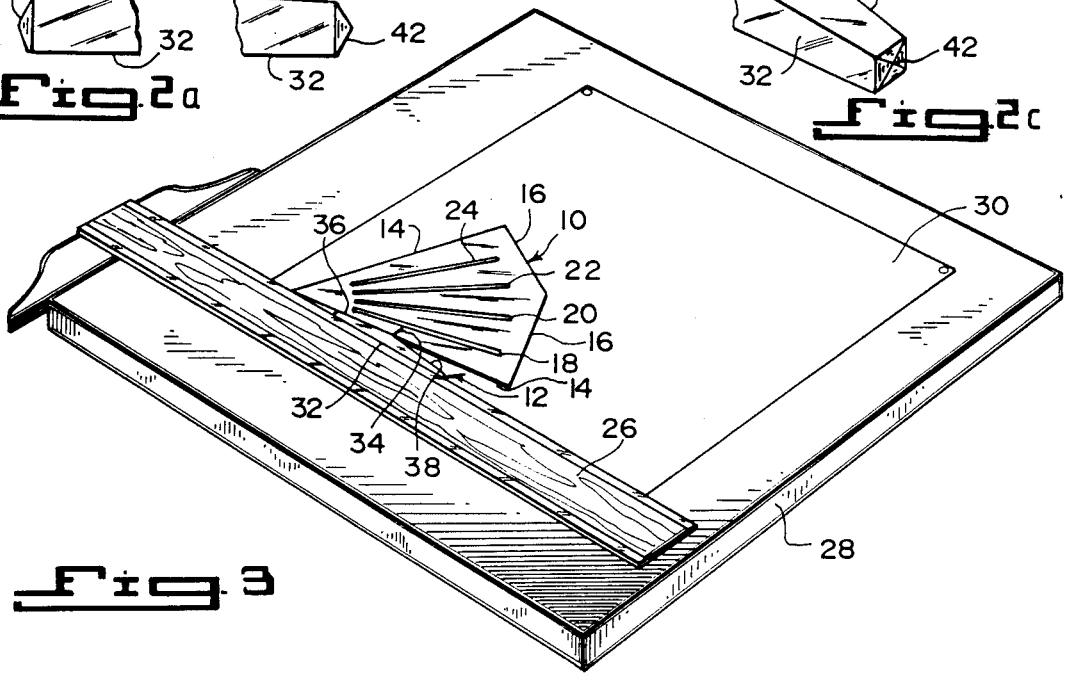
FIG. 3 is a perspective view of the instant invention in use with a T-square on a drawing board.

Turning now descriptively to the drawings, in which similar reference characters denote similar elements throughout the several views, FIGS. 1 through 6 illustrates an improved angle drafting set basically consisting of a trapezium tool 10 and an angle modifier tool 12.

The trapezium tool 10 has two long edges 14 of equal length and two short edges 16 of equal length. The two long edges 14 form an angle of forty five degrees, while the two short edges 16 opposite from the forty five degree angle form an angle of one hundred and thirty five degrees. Where each of the two long edges 14 meet with each of the short edges 16 an angle of ninety degrees is formed. The trapezium tool 10 further has four elongated slots 18, 20, 22 and 24 therein. The first slot 18 is placed at a five degree angle from one of the long edges 14, while the other three slots 20, 22 and 24 are placed at ten degree increments from the first slot 18. By positioning the trapezium tool 10 in various positions against a T-square 26 on a drafting board 28, a person can accurately draw angles in five degree increments between zero degrees and three hundred and sixty degrees, onto a piece of paper 30.

The angle modifier tool 12 has a straight bottom edge 32 and a top edge 34 divided with one side 36 at a one degree angle and the other side 38 at a two degree angle. When the angle modifier tool 12 is used in conjunction with the trapezium tool 10 on the T-square 26, the person can accurately draw angles in whole degree increments between zero degrees and three hundred and sixty degrees. The trapezium tool 10 and the angle modifier tool 12 are both of the same thickness and fabricated out of a hard clear durable plastic material.

The trapezium tool 10 can further include two double beveled cut off corner tips 40. Each tip 40 is located where each of the two long edges 14 meet with each of the short edges 16 to form the ninety degree angle so that the fingers of the person can easily pick up and lift the trapezium tool 10 from any flat surface, such as the drawing board 28, while it is laying on either side.

The angle modifier tool 12 can further include two double beveled edges 42. Each double beveled edge 42 is located at each side thereof so that the fingers of the person can easily pick up and lift the angle modifier tool 12 from any flat surface, such as the drawing board 28, while it is laying on either side.

FIGS. 7, 8 and 9 show a first modified trapezium tool 10*a* having two enlarged spaces 44 and 46. The first enlarged space 44 extends between where the first and second slots 18 and 20 were located, so that the bottom edge 48 of the first enlarged space 44 takes the place of the first slot 18, while the top edge 50 of the first enlarged space 44 takes the pace of the second slot 20. The second enlarged space 46 extends between where the third and fourth slots 22 and 24 were located, so that the bottom edge 52 of the second enlarged space 46 takes the place of the third slot 22, while the top edge 54 of the second enlarged space 46 takes the place of the fourth slot 24.

Each of the first and second enlarged spaces 44 and 46 further includes two inner beveled side edges 56 and 58 so that the fingers of the person can easily pick up and lift the trapezium tool 10*a* from any flat surface.

FIG. 10 shows a second modified trapezium tool 10*b* in which the two long edges 14 and the two short edges 16 can be each divided into five equal segments 60, 62, 64, 66 and 68 in which the third center segment 64 is straight, the second and fourth segments 62 and 66 are at a one degree angle while the first and fifth segments 60 and 68 are at a two degree angle. Only one long edge 14 is shown with the five equal segments. Since this configuration is similar to the top edge 34 of the angle modifier tool 12 the angle modifier tool 12 is eliminated and the second modified trapezium tool 10*b* can provide angles in whole degree increments between zero degrees and three hundred and sixty degrees.

LIST OF REFERENCE NUMBERS

10: trapezium tool
10*a*: first modified trapezium tool
10*b*: second modified trapezium tool
12: angle modifier tool
14: long edges on 10, 10*a* and 10*b*
16: short edges of 10, 10*a* and 10*b*
18: first elongated slot in 10
20: second elongated slot in 10
22: third elongated slot in 10
24: forth elongated slot in 10
26: T-square
28: drafting board
30: piece of paper
32: straight bottom edge on 12
34: top edge on 12
36: one side of 34
38: other side of 34
40: double beveled cut off corner tip on 10
42: double beveled edge on 12
44: enlarged space in 10*a*
46: enlarged space in 10*a*
48: bottom edge of 44
50: top edge of 44
52: bottom edge of 46
54: top edge of 46
56: inner beveled side edge in 44, 46
58: inner beveled side edge in 44, 46
60: first equal segment of 14, 16
62: second equal segment of 14, 16
64: third equal segment of 14, 16
66: fourth equal segment of 14, 16
68: fifth equal segment of 14, 16

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed is new and desired to be protected by Letters Patent is set forth in the appended claims:

1. An improved angle drafting set comprising:

(a) a trapezium tool having two long edges of equal length and two short edges of equal length, whereby the two long edges form an angle of forty five degrees, while the two short edges opposite from the forty five degree angle form an angle of one hundred and thirty five degrees and where each of the two long edges meet with each of the short edges an angle of ninety degrees is formed, said trapezium tool further having four elongated slots therein, wherein the first slot is placed at a five degree angle from one of the long edges, while the other three slots are placed at ten degree increments from the first slot so that by positioning said trapezium tool in various positions against a T-square a person can accurately draw angles in five degree increments between zero degrees and three hundred and sixty degrees; and (b) an angle modifier tool having a straight bottom edge and a top edge divided with one side at a one degree angle and the other side at a two degree angle so that when said angle modifier tool is used in conjunction with said trapezium tool on the T-square the person can accurately draw angles in whole degree increments between zero degrees and three hundred and sixty degrees.

2. An improved angle drafting set as recited in claim 1, wherein said trapezium tool and said angle modifier tool are both of the same thickness and fabricated out of a hard clear durable plastic material.

3. An improved angle drafting set as recited in claim 2, wherein said trapezium tool further includes two double beveled cut off corner tips, each located where each of the two long edges meet with each of the short edges to form the ninety degree angle so that the fingers of the person can easily pick up and lift said trapezium tool from any flat surface, while it is laying on either side.

4. An improved angle drafting set as recited in claim 3, wherein said angle modifier tool further includes two double beveled edges, each located at each side thereof so that the fingers of the person can easily pick up and lift said angle modifier tool from any flat surface, while it is laying on either side.

5. An improved angle drafting set as recited in claim 2, wherein said trapezium tool further having two enlarged spaces wherein the first enlarged space extends between where the first and second slots were located so that the bottom edge of the first enlarged space takes the place of the first slot, while the top edge of the first enlarged space takes the place of the second slot and the second enlarged space extends between where the third and fourth slots were located, so that the bottom edge of the second enlarged space takes the place of the third slot, while the top edge of the second enlarged space takes the place of the fourth slot.

6. An improved angle drafting set as recited in claim 5, wherein each of the first and second enlarged spaces further includes two inner beveled side edges so that the fingers of the person can easily pick up and lift said trapezium tool from any flat surface.

* * * * *